US005354006A

United States Patent [19]

Röder

[11] Patent Number: 5,354,006

[45] Date of Patent: Oct. 11, 1994

[54] PAPER WEB SUPPLY ASSEMBLY

[75] Inventor: Klaus W. Röder, Würzburg, Fed. Rep. of Germany

[73] Assignee: Koenig & Bauer Aktiengesellschaft, Wurzburg, Fed. Rep. of Germany

[21] Appl. No.: 965,869

[22] Filed: Oct. 23, 1992

[30] Foreign Application Priority Data

Oct. 24, 1991 [DE] Fed. Rep. of Germany ..... 4135101

[51] Int. Cl.[5] ..... B65H 19/14

[52] U.S. Cl. ..... 242/555.3; 242/554.2; 242/554.4; 242/556

[58] Field of Search ..... 242/58.1, 58.3, 58.5, 242/56 R

[56] References Cited

U.S. PATENT DOCUMENTS

| | | | |
|---|---|---|---|
| 3,841,944 | 10/1974 | Harris | 242/58.1 X |
| 3,863,854 | 2/1975 | Tokuno . | |
| 4,082,599 | 4/1978 | Kozima | 242/58.3 X |
| 4,089,482 | 5/1978 | Mooney et al. | 242/58.1 |
| 4,169,752 | 10/1979 | Tokuno . | |
| 4,170,506 | 10/1979 | Marschke . | |
| 4,481,053 | 11/1984 | Tokuno et al. . | |
| 4,735,372 | 4/1988 | Seki | 242/58.1 |
| 4,763,851 | 8/1988 | Flament | 242/58.3 |
| 4,816,111 | 3/1989 | Pittarello et al. | 242/58.3 X |
| 4,948,061 | 8/1990 | Krimsky et al. | 242/58.3 |
| 5,033,688 | 7/1991 | Georgitsis et al. | 242/58.1 |
| 5,083,718 | 1/1992 | Chen | 242/58.1 |

FOREIGN PATENT DOCUMENTS

| | | |
|---|---|---|
| 328854 | 12/1971 | Austria . |
| 320427 | 7/1972 | Austria . |
| 364795 | 12/1977 | Austria . |
| 381682 | 9/1982 | Austria . |

*Primary Examiner*—Daniel P. Stodola
*Assistant Examiner*—Eileen A. Dunn
*Attorney, Agent, or Firm*—Jones, Tullar & Cooper

[57] ABSTRACT

A paper web supply assembly utilizes a pair of paper roll support arm assemblies to hold two paper rolls. Two gluing carriages are carried by side plates of the press and each of these carriages is movable toward and away from a receiving rod that supports a corresponding paper roll. The gluing carriage is used to position a paper web from a fresh paper roll to accomplish a flying web splice.

8 Claims, 5 Drawing Sheets

PAPER WEB SUPPLY ASSEMBLY

FIELD OF THE INVENTION

The present invention is directed generally to a paper web supply assembly. More particularly, the present invention is directed to a paper web supply assembly for accomplishing a paper roll change in a rotary printing press. Most specifically, the present invention is directed to a paper web supply assembly for accomplishing a flying paper web change using a movable gluing carriage. A working paper web roll and a replacement paper web roll are supported in supporting arms in the press frame. A gluing carriage carries a paper web gluing roller and a paper web cutter. The gluing carriage is movable toward the replacement paper roll and is actuated upon sensing of the depletion of the working paper roll to adhere the working paper web to the replacement web and to sever the trailing end of the depleted web thereby accomplishing a flying paper web change.

DESCRIPTION OF THE PRIOR ART

In rotary printing presses and particularly in rotary printing presses that are used for printing newspapers, it is necessary to accomplish the changing of paper rolls in a rapid, dependable manner in order to avoid any production losses. Such losses occur when the speed of operation of the presses must be slowed down so that the paper roll change can be accomplished. In some instances, if the paper roll change is not accomplished in an expeditious manner, it may be necessary to halt the operation of the press. Such a halt in operation clearly leads to significant production losses in the printing of newspapers on a rotary printing press.

Automatically operating, double-armed roll changing devices are generally known in the art. In these prior devices there is provided a support arm which is supported for rotation or pivotal motion at a central point by a shaft. This support arm carries a paper roll on each end. The fresh paper web is placed on the paper web that is running out by rotation of the support arm of the roll changer about its central point and by use of a gluing device. Changing the roll and thus the paper web takes place by bringing the full roll of paper up to proper rotational speed and by gluing the fresh web to the depleting web when both have the same speed.

In these prior art devices there is a need for a large amount of space since the support arm or arms that carry the paper rolls at its ends must pivot about a central axis. Given the diameters of the two paper rolls, there is a minimum structural height which is required for these prior devices. However, it is often necessary to provide printing units which are as compact as possible so that the space enclosing the press installation can be as small as possible. These prior art roll changing devices also often cannot be used in old, existing building. Furthermore, the costs associated with providing large enclosed areas to accommodate these prior art paper roll changing devices are quite expensive.

One paper roll changing device that has a low structural requirement is shown in U.S. Pat. No. 4,735,372. In this prior art device, the rolls to be changed are moved around horizontally seated pivot shafts by means of pivot arms. The paper web from the fresh roll is connected to the paper web from the depleted roll by a paper web splicing press. One such splicing press that is usable with this prior assembly is shown in U.S. Pat. No. 4,170,506. This splicing press is able to connect paper webs only while the webs are stationary. In order to allow the paper web to be stopped to accomplish the web splice, the continuously operating printing press must be provided with paper from a previously established paper web reservoir. This paper web reservoir is formed by suitable clamping rollers and is located above the splicing press.

A limitation of this prior art roll changing device which performs a web splice or gluing procedure only when the paper rolls are standing still is that the length of time during which the procedure must be accomplished is limited by the storage capacity of the paper web reservoir. Devices of this type are not suitable for use in high output rotary printing presses because of the loss of production that entails from the need to stop the paper web during splicing.

It will be seen that a need exists for a paper web changing assembly that overcomes the limitations of the, prior art devices. The paper web supply assembly in accordance with the present invention provides such a device and is a significant improvement over the prior art devices.

SUMMARY OF THE INVENTION

It is an object of the present invention to provide a paper web supply assembly.

Another object of the present invention is to provide a paper web supply assembly for accomplishing a paper roll change.

A further object of the present invention is to provide a paper web supply assembly for accomplishing a flying paper roll change.

Still another object of the present invention is to provide a paper web supply assembly which utilizes movable gluing carriages.

Yet a further object of the present invention is to provide a paper web supply assembly which has a low structural height.

Even still another object of the present invention is to provide a paper web supply assembly that can be used in high output rotary printing presses.

As will be discussed in greater detail in the description of the preferred embodiment which is set forth subsequently, the paper web supply assembly utilizes a pair of paper roll support arm assemblies which are secured to side walls of a press frame. One roll support arm assembly holds the working roll from which a paper web is being drawn and the other roll support arm assembly carries the replacement roll. A pair of movable gluing carriages are slidably supported in the press side frames with each carriage being movable toward and away form the axis of rotation of one of the paper rolls. Each gluing carriage is movable in guide ribs or rails by a suitable motor and carries a gluing roller between pivotable levers, and a paper web cutter. When a paper web change is needed, the appropriate gluing carriage moves the depleting web toward the periphery of the rotating full replacement roll. The gluing roller accomplishes the connection and the tail of the depleted web is cut off by the cutter.

A particular advantage of the paper web supply assembly of the present invention is its ability to accomplish a flying paper roll change without the need for a pit or large structure since the paper rolls do not move or pivot about a central point as was required in the prior art double arm assemblies. The use of a paper reservoir during the changing of the rolls is also not required since the change is accomplished on the fly.

The paper web supply assembly in accordance with the present invention accomplishes the flying web change in a simple, expeditious manner while overcoming the limitations of the prior art devices. It provides a substantial advance in the art.

BRIEF DESCRIPTION OF THE DRAWINGS

While the novel features of the paper web supply assembly in accordance with the present invention are set forth with particularity in the appended claims, a full and complete understanding of the invention may be had by referring to the detailed description of the preferred embodiment which is presented subsequently, and as illustrated in the accompanying drawings in which:

DESCRIPTION OF THE PREFERRED EMBODIMENT

Figure 1:
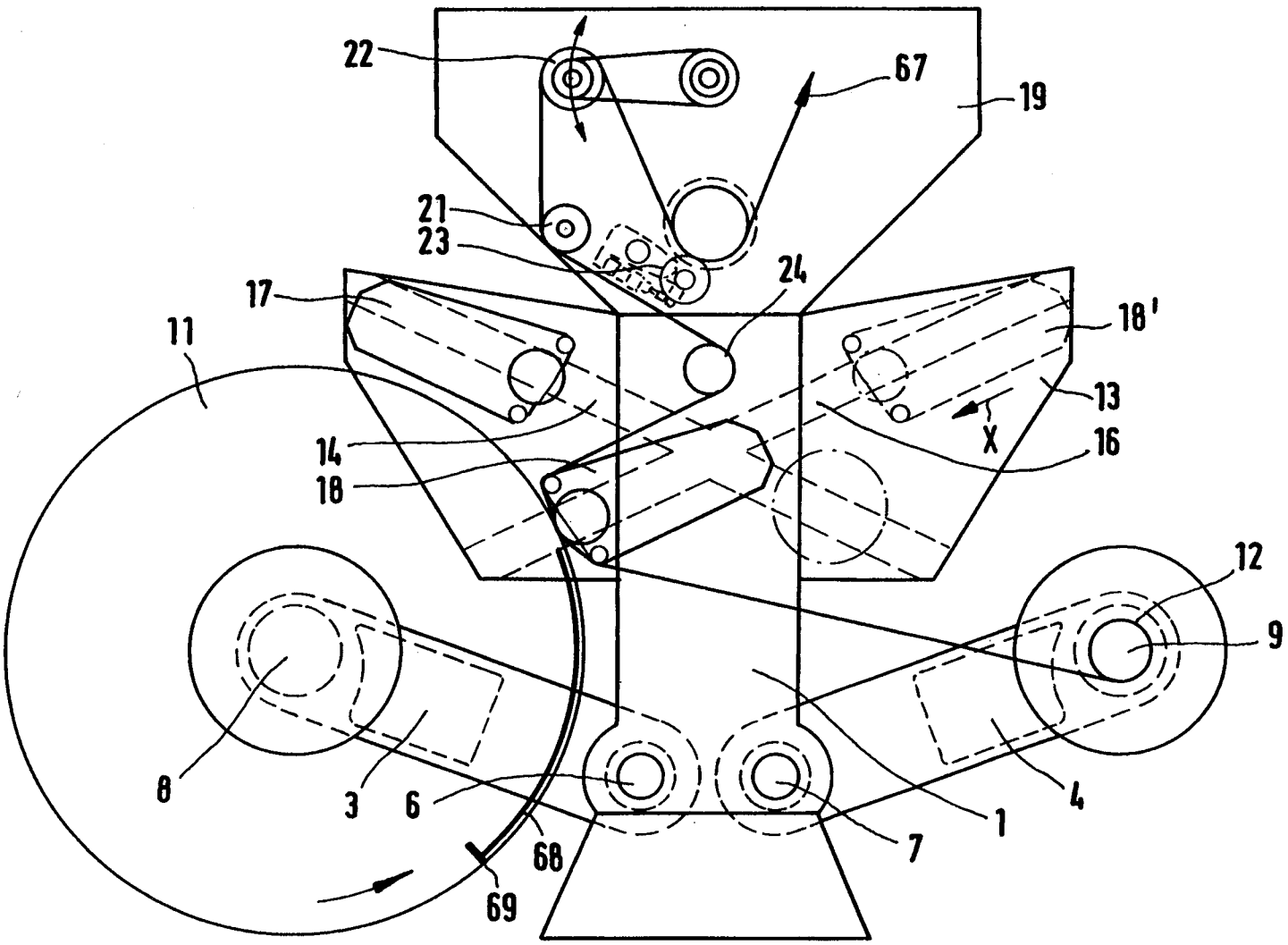
FIG. 1 is a schematic side elevation view of a preferred embodiment of a paper web supply assembly in accordance with the present invention.

Turning initially to FIG. 1 there may be seen a preferred embodiment of a paper web supply assembly in accordance with the present invention. The paper web supply assembly is positioned between, and supported by spaced side frames 1 and 2 of a rotary printing press. In FIG. 1, only the side frame 1 is shown with the other side frame being omitted for clarity. Two paper roll support arm assemblies 3 and 4 are each pivotably secured between side frames 1 and 2 by suitable bearings 6 and 7. Each paper roll support arm assembly 3 or 4 supports a paper roll 11 or 12, respectively between its spaced arms. Each of the paper rolls 11 or 12 is supported between the spaced arms of its respective roll support assembly 3 or 4 on roll receiving rods 8 or 9, respectively. These roll receiving rods 8 and 9 are each provided with suitable paper roll driving and braking motors which are not specifically shown. The working positions of the paper roll support arm assemblies 3 and 4 is generally horizontal, as shown in FIG. 1. These arm assemblies can move to accomplish paper roll loading but they do not pivot or rotate to move the rolls into an operating position as is the case in various ones of the prior art devices.

Referring again primarily to FIG. 1, a first guide plate 13 is secured to each one of the side frames 1 and 2 generally above the paper roll support arm assemblies 3 and 4. Each guide plate 13 has first and second guide ribs, generally at 14 and 16 with these guide ribs supporting first and second gluing carriages 17 and 18, respectively. Each of these gluing carriages 17 and 18 can be moved along the cooperating guide ribs 14 and 16, respectively toward and away from its associated paper roll 12 and 11. The direction of movement of the gluing carriage 18 toward its associated paper roll 11 is indicated by the arrow X in FIG. 1. The gluing carriage 17, which is associated with paper roll 12, is shown in its rest position in FIG. 1. The gluing carriage 18, which is associated with paper roll 11, is shown in its gluing position against roll 11 in solid lines. Its rest position is shown in dashed lines at 18'. The directions of travel of the gluing carriages 17 and 18 are toward and away from the receiving rods 9 and 8 of the paper rolls 12 and 1, again as indicated by arrow X. These paths of travel of the gluing carriages 17 and 18 are defined by their associated guide ribs, generally at 14 and 16, respectively, as will be discussed shortly.

As may also be seen in FIG. 1, the spaced side frames 1 and 2 of the rotary press also support second, spaced guide plates 19. These guide plates 19 form the end supports for a paper web guide roller 21, a compensating roller 22 and a pair of pulling rollers 23. An additional guide roller 24 and suitable reversing rollers are supported between the first, spaced guide plates 13. As will be discussed in greater detail shortly, a paper web 67 which is being fed from depleted paper roll 12 will be attached to the paper web on full roll 11 to accomplish a flying web change. The web 6 is then fed around the guide roller 21, the compensating roller 22 and the pulling rollers 23 on its way to further press equipment. The guide roller 24 which is supported between the first, spaced guide plates 13 comes into use only during web splicing.

Figure 2:
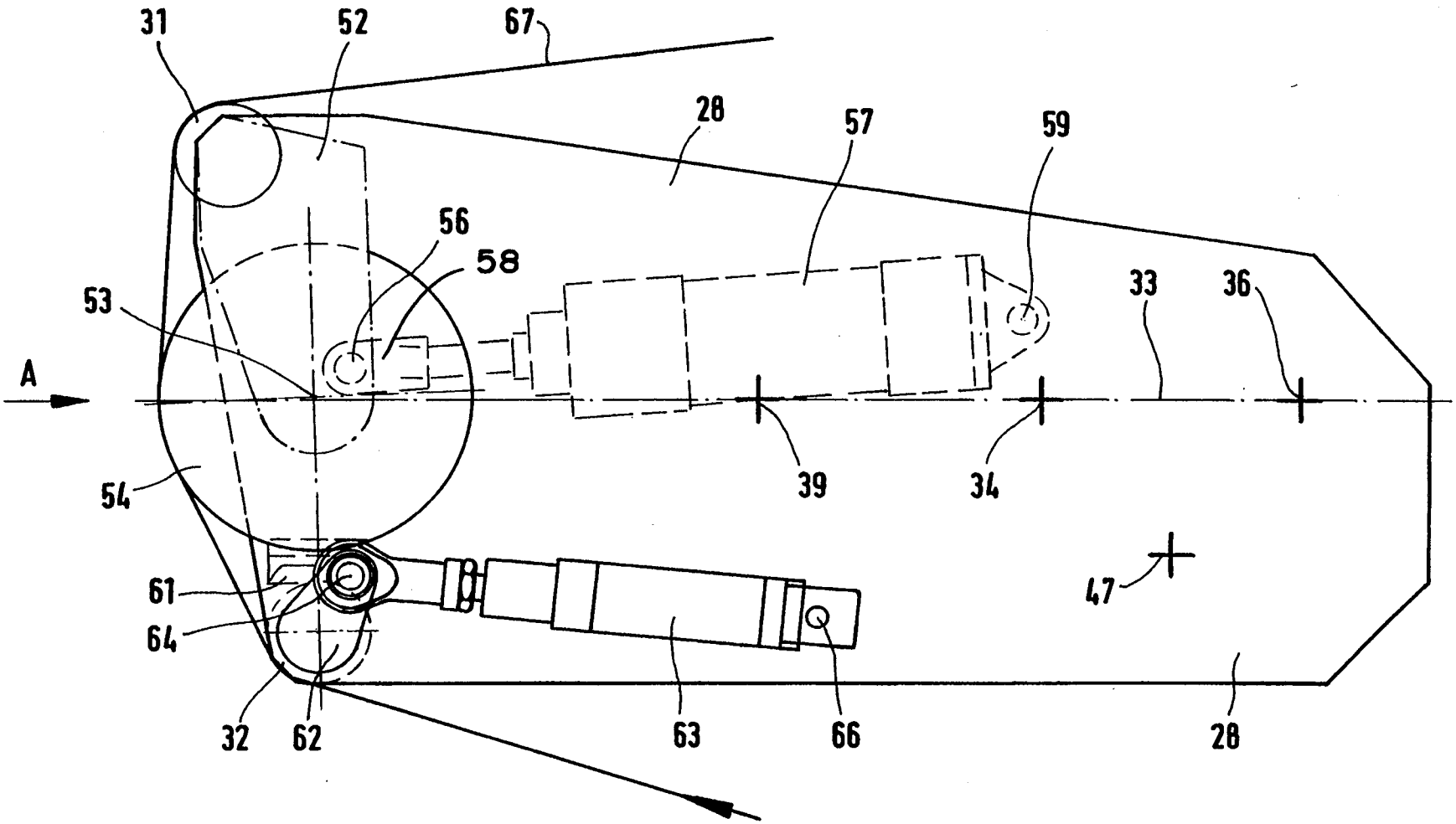
FIG. 2 is an enlarged side elevation view of a gluing carriage portion of the invention.

Referring now more particularly to FIGS. 2–5, the operation of gluing carriage 18 in the accomplishment of the web change from depleted paper roll 12 to full paper roll 11, as depicted in FIG. 1, will be discussed in detail. The gluing carriage 18 shown in FIG. 2 is depicted in its working position in which the paper web 67 from paper roll 12 is being pushed against the outer surface of the paper web on roll 11. The paper web 67 is pushed by a gluing roller 54 whose operation will be discussed subsequently.

Figure 3:
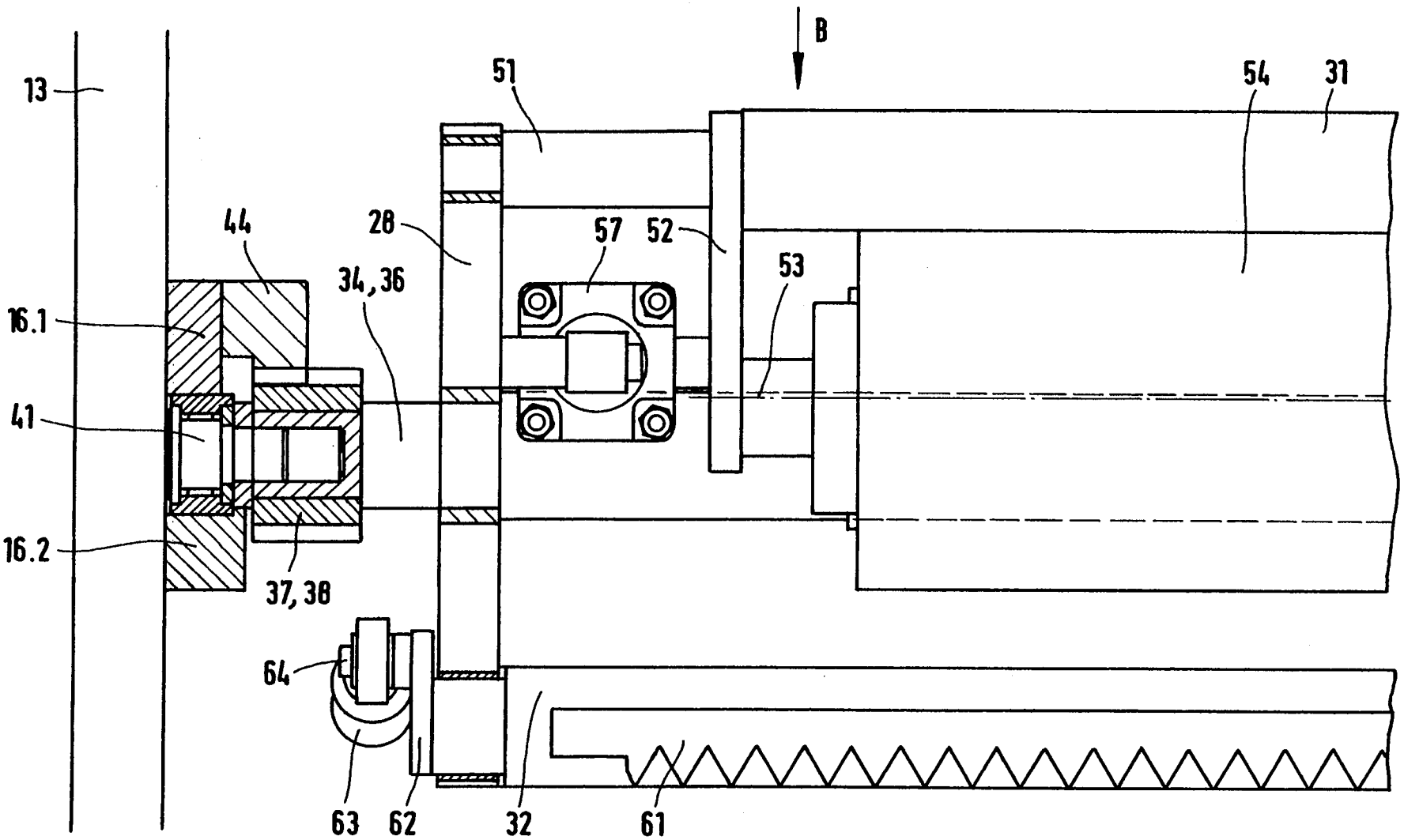
FIG. 3 is a front elevation view of the gluing carriage, partly in section, and taken in the direction indicated by arrow A in FIG. 2.
Figure 4:
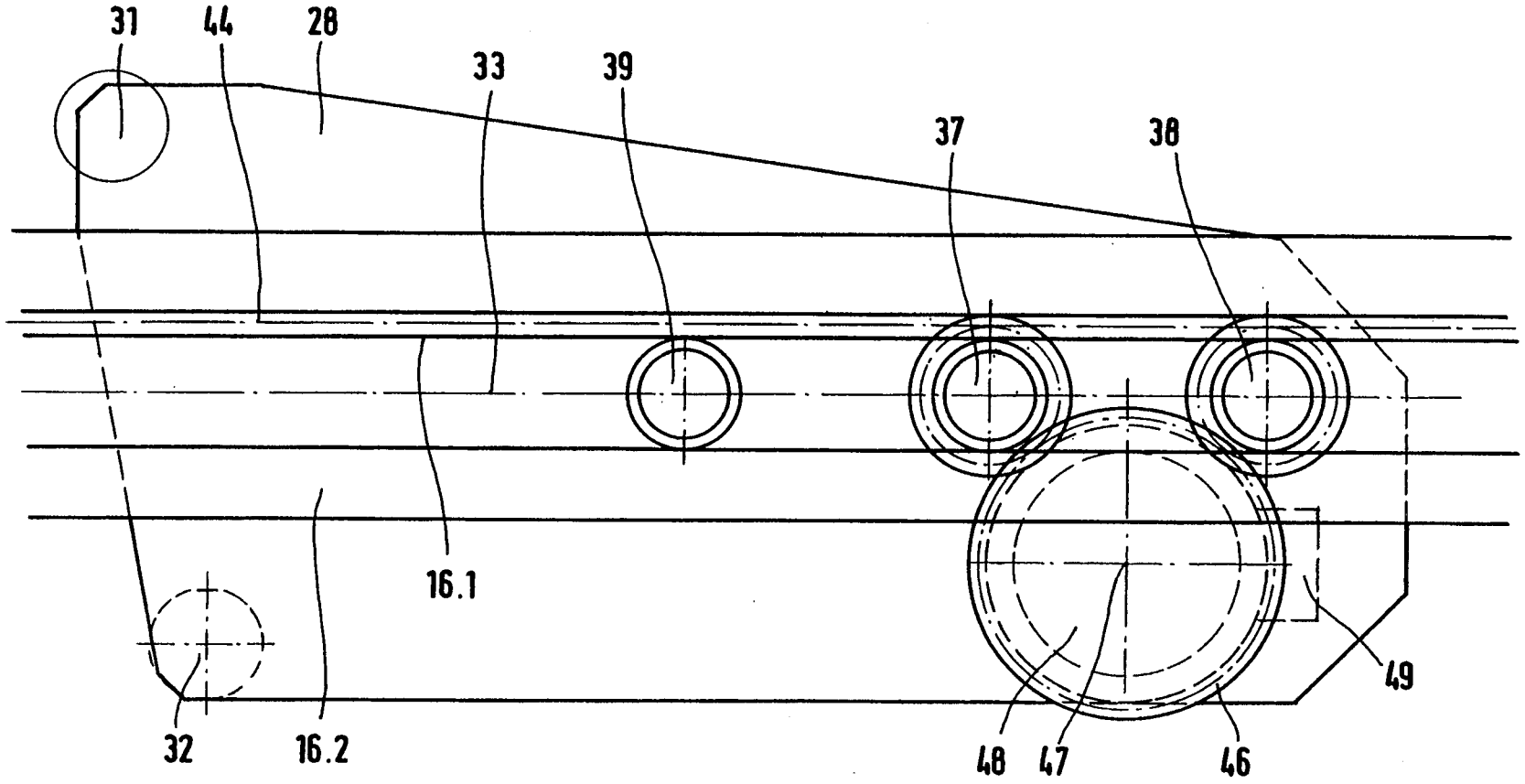
FIG. 4 is a view generally similar to FIG. 2 and showing the drive for the gluing carriage.
Figure 5:
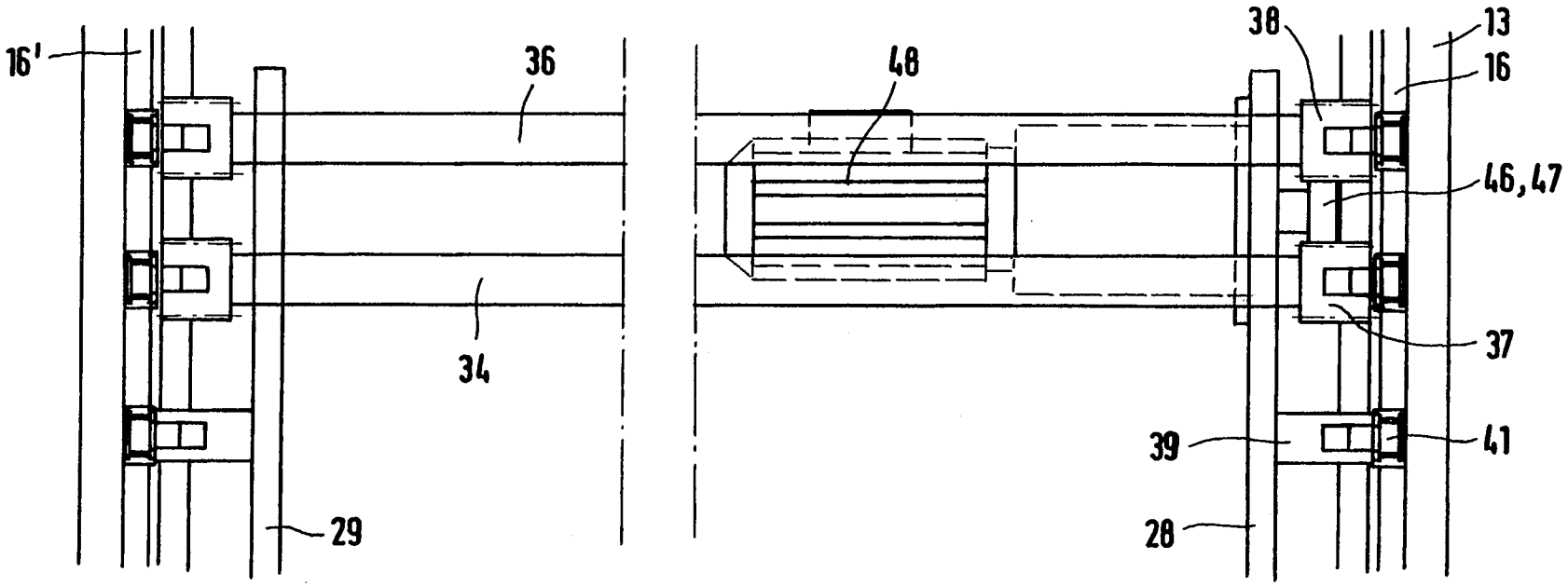
FIG. 5 is a top plan view of the drive portion of the gluing carriage and taken in the direction indicated by arrow B in FIG. 3.

Gluing carriage 18 is comprised of two spaced gluing plates 28 and 29 with only plate 28 being shown in FIGS. 2, 3 and 4 and with both gluing plates 28 and 29 being shown in FIG. 5. These two gluing plates 28 and 29 are maintained in a spaced apart configuration by a pair of paper guide spindles 31 and 32 which extend between the spaced plates 28 and 29 generally at right angles to plates 28 and 29. These guide spindles 31 and 32 are located between the gluing plates 28 and 29 generally at front corners of plates 28 and 29 closest to the paper roll 11 to be spliced.

A pair of drive shafts 34 and 36 extend between the two spaced gluing plates 28 and 29, as may be seen most clearly in FIG. 5. These drive shafts 34 and 36, as well as a pair of drive spindles 39 have their axes of rotation along a center line 33 of each of the gluing plates 28 and 29, as is indicated in FIG. 2. The shafts 34 and 36 carry toothed drive gears 37 and 38, which are shown in FIGS. 3 and 5, at their outer ends which drive gears are exterior of the gluing plates 28 and 29. Each of the drive shafts 34 and 36, as well as the drive spindles 39 are equipped with pulley wheels 41 at their outermost ends. As may be seen in FIG. 3, each pulley wheel 41 is guided between an upper guide rib 16.1 and a lower guide rib 16.2 with these two guide ribs 16.1 and 16.2 cooperating to form the guide rib 16 generally. These pulleys 41 situated at the ends of the drive shafts 34 and 36 and the ends of the drive spindles 39 support the gluing carriage 18 and keep it stable during its movement in guide rib assemblies 16 between its rest position 18′ and its use position shown in FIG. 1 and discussed previously.

A toothed rack 44 overlies each of the toothed drive gears 37 and 38 for the drive shafts 34 and 36. These toothed racks 44 are secured to the upper guide rib component 16.1 of each of the guide ribs 16. The toothed drive gears 37 and 38 at one end of the drive shafts 34 and 36 are also in drive engagement with a toothed drive wheel 46. This toothed drive wheel 46 is secured to a shaft 47 of a reversible electric motor 48, as shown in FIGS. 4 and 5. The electric motor 48 is provided with a suitable electrical connection 49 so that the motor 48 can be controlled. When the motor 48 is actuated, it drives toothed drive wheel 46. This causes drive gears 37 and 38 to rotate and to turn drive shafts 34 and 36. Since the drive gears 37 and 38 are in connection with the toothed rack 44, rotation of the drive gears 37 and 38 will advance the gluing carriage 18 toward the paper roll 11 or away from roll 11, depending on the direction of rotation of motor 48. The pulleys 41 at the ends of the drive shafts 34 and 36 and at the ends of the drive spindles 39 provide a stable support for the gluing carriage 18.

Returning primarily to FIGS. 2 and 3, a pair of roller pivot levers 52 are pivotably supported at their upper ends by the spaced ends of the upper forward paper guide spindle 31. These roller pivot levers 52 support a cutter shaft 53 which, in turn, carries the gluing roller 54 which was referred to briefly previously in the specification. Each pivot lever 52 has a coupling point 56 at which it is connected to a piston rod of a working cylinder 57. These coupling points 56 are formed by a yolk 58 and associated bolts. The opposite end of the working cylinder 57 is connected at a coupling point 59 to each of the gluing plates 28 and 29.

A paper web cutter 61 that can sever the paper web 67 is placed between the gluing plates 28 and 29 generally adjacent the gluing roller 54. Each end of the web cutter 61 is supported by one end of a pivot lever 62. A piston rod of a cutter operating cylinder 63 is connected to each cutter pivot lever 62. An opposite end of each cutter working cylinder 63 is attached at a coupling point 66 to one of the gluing plates 28 and 29. The two working cylinders 57 and 63 for the gluing roller 54 and the cutter 61, respectively in the preferred embodiment are pneumatic cylinders. As has been discussed above, these working cylinders, pivot links and coupling points are provided on each gluing plate 28 and 29. In contrast, only one electric drive motor 48 is provided for the gluing carriage 18. It will be understood that while the discussion has been directed to the gluing carriage 18 that the same structure is used for gluing carriage 17 which operates in the same manner as gluing carriage 18.

In operation of the paper web supply assembly of the present invention, it will be assumed that, as depicted in FIG. 1, the paper web 67 from paper roll 12 is to be spliced or glued to the peripheral outer surface of the paper roll 11 since paper roll 12 is becoming depleted. After the paper roll 12 has reached a preset level of depletion, the full paper roll 11 is brought up to a rotational speed such that the circumferential speeds of the paper rolls 11 and 12 are the same. The gluing carriage 18 is then moved by the drive motor 48 from its rest position shown with dashed lines at 18′ to its use position. As the gluing carriage 18 moves toward the receiving rod 8 that supports the full paper roll 11 between the spaced arms of the roll support arm assembly 3, the gluing cylinder 54 engages the paper web 67 which is running off paper roll 12. The paper web 67 now also runs over the paper guide spindles 32 and 31 on the gluing carriage 18 as well as the gluing roller 54 that is disposed between them. As the gluing carriage 18 moves toward the full paper roll 11, the paper web wraps around the guide roller 24.

As may be seen in FIG. 1, the full paper roll 11 is provided on its outer periphery with a prepared adhesive section 68 which may be a suitable glue, and with a piece or section of reflecting foil 69. After the reflecting foil 69 has been scanned by a suitable photoelectric cell or the like, which is not specifically shown, the gluing roller 54 is moved forwardly toward the rotating full paper roll 11 by operation of the working cylinders 57. This connects the moving paper web 67 from depleting roll 12 with the leading end of the paper web on the full roll 11. At the time of connection, the cutter working cylinders 63 are actuated so that the cutter 61 will sever the paper web 67 behind the glued line. Now the paper web will be fed from the full paper roll 11 while the depleted paper roll 12 can be changed. Once the gluing carriage 18 has performed its task, it is moved along its guide ribs 16 back to its rest position 18′. As the paper roll 11 becomes depleted, it will now be necessary to utilize the other gluing carriage 17 to make the next paper web splice or gluing connection by moving along the guide ribs 14 toward the receiving rod 9 that supports the now full paper roll 12′ which is not shown in the drawings.

It will be understood that the coordination of the speed of the paper web and the rotational speed of the replacement paper roll, as well as the controls for the movement of the gluing carriages and the actuation of the gluing rollers and the paper web rollers could be accomplished manually or by utilization of the computer controls of the printing press. The specific controls are not part of the subject invention.

The paper web supply assembly in accordance with the present invention allows there to be accomplished a flying paper roll exchange in a simple manner at full production speed. There is a substantial reduction in structure height provided by the present invention without the need for a paper reservoir. While a preferred embodiment of a paper web supply assembly in accordance with the present invention has been set forth fully and completely hereinabove, it will be apparent to one of skill in the art that a number of changes in, for example, the size of the paper rolls, the type of adhesive used, the drive motors for the paper rolls and the like could be made without departing from the true spirit and scope of the present invention which is accordingly to be limited only by the following claims.

What is claimed is:

1. A paper web supply assembly which is usable to accomplish a flying paper web splice in a rotary printing press, said paper web supply assembly comprising:

spaced first and second side frames;

first and second paper roll support arm assemblies positioned between said first and second side frames and usable to support first and second paper rolls for rotation about first and second paper roll receiving rods;

a first movable gluing carriage cooperable with said first paper roll and a second movable gluing carriage cooperable with said second paper roll;

first and second gluing carriage guide plates secured to said spaced first and second side frames above said first and second paper roll support arm assemblies;

first and second downwardly extending guide ribs in each of said first and second gluing carriage guide plates, said first guide ribs supporting said first gluing carriage and said second guide ribs supporting said second gluing carriage;

means to move said first gluing carriage along said first guide ribs downwardly toward, and upwardly away from said first paper roll receiving rod and means to move said second gluing carriage along said second guide ribs downwardly toward, and upwardly away from said second paper roll receiving rod; and a gluing roller on each of said first and second gluing carriages, each said gluing roller being movable with its associated one of said first and second gluing carriages to contact a paper web from a depleting one of said first and second paper rolls during selective movement of said first or second gluing carriage downwardly toward a full one of said first or second paper rolls supported on said first or second paper roll receiving rods and to move said depleting paper web into contact with a surface of said full one of said first and second paper rolls to effect a flying paper web splice.

2. The paper web supply assembly of claim 1 wherein each of said first and second gluing carriages is comprised of spaced gluing plates.

3. The paper web supply assembly of claim 1 further including a paper web cutter on each of said gluing carriages.

4. The paper web supply assembly of claim 1 wherein each said gluing roller is pivotably supported on each of said gluing carriages by roller pivot arms.

5. The paper web supply assembly of claim 4 further including working cylinders for moving said roller pivot arms and said gluing roller.

6. The paper web supply assembly of claim 1 wherein said means to move each of said first and second gluing carriages in said first and second guide ribs in each of said gluing carriage guide plates secured to said side frames includes pulley wheels supporting said gluing carriages in said first and second guide ribs.

7. The paper web supply assembly of claim 6 further including toothed racks secured to said side frames and drive gears on said gluing carriages engaged with said toothed racks.

8. The paper web supply assembly of claim 7 further including a drive motor on each of said gluing carriages, said drive motor driving said drive gears.

* * * * *